US006855034B2

(12) United States Patent
Hasegawa

(10) Patent No.: US 6,855,034 B2
(45) Date of Patent: Feb. 15, 2005

(54) POLISHING PAD FOR SEMICONDUCTOR WAFER AND LAMINATED BODY FOR POLISHING OF SEMICONDUCTOR WAFER EQUIPPED WITH THE SAME AS WELL AS METHOD FOR POLISHING OF SEMICONDUCTOR WAFER

(75) Inventor: Kou Hasegawa, Mie (JP)

(73) Assignee: JSR Corporation, Tokyo (JP)

( * ) Notice: Subject to any disclaimer, the term of this patent is extended or adjusted under 35 U.S.C. 154(b) by 104 days.

(21) Appl. No.: 10/128,282

(22) Filed: Apr. 24, 2002

(65) Prior Publication Data

US 2002/0173231 A1 Nov. 21, 2002

(30) Foreign Application Priority Data

Apr. 25, 2001 (JP) ..... 2001-128482
Apr. 25, 2001 (JP) ..... 2001-128483

(51) Int. Cl.[7] ..... B24B 1/00

(52) U.S. Cl. ..... 451/41; 451/6; 451/8; 451/10; 451/286; 451/287; 451/288; 451/289; 451/526; 451/527; 451/529

(58) Field of Search ..... 451/6, 8, 10, 41, 451/286, 287, 288, 289, 526, 527, 529

(56) References Cited

U.S. PATENT DOCUMENTS

| | | | | |
|---|---|---|---|---|
| 5,900,164 A | | 5/1999 | Budinger et al. | |
| 6,068,540 A | | 5/2000 | Dickenscheid et al. | |
| 6,074,287 A | | 6/2000 | Miyaji et al. | |
| 6,159,073 A | * | 12/2000 | Wiswesser et al. | 451/6 |
| 6,500,053 B2 | * | 12/2002 | James et al. | 451/41 |
| 6,517,417 B2 | * | 2/2003 | Budinger et al. | 451/41 |

FOREIGN PATENT DOCUMENTS

| | | | | |
|---|---|---|---|---|
| EP | 1 046 466 | | 10/2000 | |
| JP | 9-7985 | | 1/1997 | |
| JP | 11-512977 | | 11/1999 | |
| JP | 2000-0034416 | * | 2/2000 | C08L/100/00 |
| JP | 2000-326220 | | 11/2000 | |
| WO | WO 97/06921 | | 2/1997 | |
| WO | WO 01/43920 | | 6/2001 | |

OTHER PUBLICATIONS

U.S. Appl. No. 09/867,541, filed May 31, 2001, Ogawa et al.
U.S. Appl. No. 09/983,097, filed Oct. 23, 2001, Hasegawa et al.
U.S. Appl. No. 10/030,141, filed Jan. 28,2002, Hasegawa et al.
U.S. Appl. No. 10/128,282, filed Apr. 24, 2002, Hasegawa.
U.S. Appl. No. 10/252,696, filed Sep. 24, 2002, Hasegawa et al.
U.S. Appl. No. 10/279,843, filed Oct. 25, 2002, Konnou et al.
U.S. Appl. No. 09/995,613, filed Nov. 29, 2001, Hasegawa.
Patent Abstracts of Japan, JP 2000–034416, Feb. 2, 2000.

* cited by examiner

*Primary Examiner*—Joseph J. Hail, III
*Assistant Examiner*—Shantese McDonald
(74) *Attorney, Agent, or Firm*—Oblon, Spivak, McClelland, Maier & Neustadt, P.C.

(57) ABSTRACT

An objective of the present invention is to provide a polishing pad for a semiconductor wafer and a laminated body for polishing of a semiconductor wafer equipped with the same which can perform optical endpoint detection without lowering the polishing performance as well as methods for polishing of a semiconductor wafer using them. The polishing pad of the invention comprises a water-insoluble matrix material such as crosslinked 1,2-polybutadiene, and a water-soluble particle such as β-cyclodextrin dispersed in this water-insoluble matrix material, and has a light transmitting properties so that a polishing endpoint can be detected with a light.

57 Claims, 9 Drawing Sheets

POLISHING PAD FOR SEMICONDUCTOR WAFER AND LAMINATED BODY FOR POLISHING OF SEMICONDUCTOR WAFER EQUIPPED WITH THE SAME AS WELL AS METHOD FOR POLISHING OF SEMICONDUCTOR WAFER

FIELD OF THE INVENTION

The present invention relates to a polishing pad for a semiconductor wafer and a laminated body for polishing of a semiconductor wafer equipped with the same as well as methods for polishing of a semiconductor wafer. More particularly, the present invention relates to a polishing pad for a semiconductor wafer through which the light can transmit and detection of a polishing endpoint with the transmitted light is easy without decreasing the polishing performance, and a laminated body for polishing of a semiconductor wafer equipped with the same as well as methods for polishing of a semiconductor wafer.

DESCRIPTION OF THE PRIOR ART

In polishing of a semiconductor wafer, determination of a polishing endpoint at which polishing is performed can be known based on the criteria of the empirically obtained time. However, there are a variety of materials constituting the surface to be polished, and polishing times are all different depending upon the materials. In addition, materials constituting the surface to be polished are considered to change variously in future. Further, this is the same in the case of slurries and polishing apparatuses used for polishing. For this reason, it is so inefficient to obtain all polishing times in a variety of different polishings. On the other hand, recently, the optical endpoint detecting apparatus and method using an optical method which can directly measure the state of the surface to be polished have been studied, for example, as in JP-A-9-7985, JP-A-2000-32622 and the like.

In this optical endpoint detection apparatus and method, generally a window having no polishing ability, which is composed of a hard uniform resin, through which the light for detecting an endpoint can transmit, is formed into a polishing pad, and the surface to be polished is measured only through this window, as disclosed in JP-A-11-512977 and the like. This window has no polishing ability, and has no essential ability such as absorption and transportation of slurry particles.

However, since the window in the above-mentioned polishing pad has no polishing ability, there is a possibility that provision of a window decreases the polishing ability of a polishing pad. In addition, since the window has substantially no ability to retain and discharge the slurry, there is a possibility that provision of a window leads nonuniformity. Therefore, it is difficult to enlarge the window, increase the number of the windows and provide the windows annularly.

SUMMARY OF THE INVENTION

The present invention is to solve the above-mentioned problems and an objective of the present invention is to provide a polishing pad for a semiconductor wafer through which the light for detecting an endpoint can transmit without lowering the polishing ability in polishing of the semiconductor wafer using an optical endpoint detecting apparatus, and a laminated body for polishing of a semiconductor wafer equipped with the same as well as method for polishing of a semiconductor wafer.

The present inventors studied a polishing pad for a semiconductor wafer using an optical endpoint detecting apparatus and found that, if not a polishing pad equipped with a small window composed of a resin having high transparency as before, as long as a material itself constituting a polishing pad has the light transmitting properties, the sufficient light transmitting properties as a window part can be maintained and, thus, a polishing endpoint can be detected with an optical endpoint detector using such a polishing pad. In addition, we found that, even when the light is scattered by the contents in a matrix constituting a polishing pad, the sufficient light transmitting properties can be still maintained.

In addition, we found that, if not using a hard uniform resin having substantially no ability to retain and discharge a slurry, sufficient light transmitting properties can be maintained by using a light transmitting part having light transmitting properties as a window, and a polishing endpoint can be detected using such a polishing pad. And, we found that, by using a window composed of a water-soluble particle, a matrix material and the like wherein the water-soluble particles are dispersed and contained therein, the ability to retain and discharge the slurry is obtained during polishing.

The present invention is based on the findings described above and can be described as follows.

1. A polishing pad for a semiconductor wafer, which comprises a water-insoluble matrix material and a water-soluble particle dispersed in the above-mentioned water-insoluble matrix material, and has light transmitting properties.

2. The polishing pad for a semiconductor wafer according to 1 above, wherein a light transmittance at a wavelength between 400 and 800 nm is 0.1% or more, or an integrated transmittance in a wavelength range between 400 and 800 nm is 0.1% or more, when a thickness is 2 mm.

3. The polishing pad for a semiconductor wafer according to 2 above, wherein the above-mentioned pad has a thin part, and an endpoint detecting light is transmitted through the above-mentioned thin part.

4. The polishing pad for a semiconductor according to 3 above, wherein at least a part of the water-insoluble matrix material is a crosslinked polymer.

5. The polishing pad for a semiconductor according to 2 above, wherein at least a part of the water-insoluble matrix material is a crosslinked polymer.

6. The polishing pad for a semiconductor according to 5 above, wherein the above-mentioned crosslinked polymer is crosslinked 1,2-polybutadiene.

7. A polishing pad for a semiconductor, which comprises a substrate for a polishing pad provided with a through hole penetrating from surface to back, and a light transmitting part fitted in the above-mentioned through hole, wherein the above-mentioned light transmitting part comprises a water-insoluble matrix material and a water-soluble particle dispersed in the above-mentioned water-insoluble matrix material.

8. The polishing pad for a semiconductor according to 7 above, wherein a light transmittance of the above-mentioned light transmitting part at a wavelength between 400 and 800 nm is 0.1% or more, or an integrated transmittance of the above-mentioned light transmitting part in a wavelength range between 400 and 800 nm is 0.1% or more, when a thickness is 2 mm.

9. The polishing pad for a semiconductor wafer according to 8 above, wherein the above-mentioned pad has a thin part, and an endpoint detecting light is transmitted through the above-mentioned thin part.

10. The polishing pad for a semiconductor according to 9 above, wherein at least a part of the water-insoluble matrix material is a crosslinked polymer.

11. The polishing pad for a semiconductor according to 8 above, wherein at least a part of the water-insoluble matrix material is a crosslinked polymer.

12. The polishing pad for a semiconductor according to 11 above, wherein the above-mentioned crosslinked polymer is crosslinked 1,2-polybutadiene.

13. A laminated body for polishing of a semiconductor wafer, which comprises a polishing pad comprising a water-insoluble matrix material and a water-soluble particle dispersed in the above-mentioned water-insoluble matrix material, and has light transmitting properties and a supporting layer laminated on a backside of the above-mentioned polishing pad, wherein the above-mentioned laminate has light transmitting properties in a laminated direction.

14. A laminated body for polishing of a semiconductor wafer, which comprises a polishing pad comprising a substrate for a polishing pad provided with a through hole penetrating from surface to back, and a light transmitting part fitted in the above-mentioned through hole, wherein the above-mentioned light transmitting part comprises a water-insoluble matrix material and a water-soluble particle dispersed in the above-mentioned water-insoluble matrix material, and a supporting layer laminated on a backside of the above-mentioned polishing pad, wherein the above-mentioned laminate has light transmitting properties in a laminated direction.

15. A method for polishing of a semiconductor wafer comprising a process of polishing a semiconductor wafer using a polishing pad comprising a water-insoluble matrix material and a water-soluble particle dispersed in the above-mentioned water-insoluble matrix material, and has light transmitting properties and a process of performing detection of a polishing endpoint using an optical endpoint detector.

16. A method for polishing of a semiconductor wafer comprising a process of polishing a semiconductor wafer using a polishing pad comprising a substrate for a polishing pad provided with a through hole penetrating from surface to back, and a light transmitting part fitted in the above-mentioned through hole, wherein the above-mentioned light transmitting part comprises a water-insoluble matrix material and a water-soluble particle dispersed in the above-mentioned water-insoluble matrix material and a process of performing detection of a polishing endpoint using an optical endpoint detector.

17. A method for polishing of a semiconductor wafer comprising a process of polishing a semiconductor wafer using a laminated body for polishing comprising a water-insoluble matrix material and a water-soluble particle dispersed in the above-mentioned water-insoluble matrix material, and has light transmitting properties and a process of performing detection of a polishing endpoint using an optical endpoint detector.

18. A method for polishing of a semiconductor wafer comprising a process of polishing a semiconductor wafer using a laminated body for polishing comprising a substrate for a polishing pad provided with a through hole penetrating from surface to back, and a light transmitting part fitted in the above-mentioned through hole, wherein the above-mentioned light transmitting part comprises a water-insoluble matrix material and a water-soluble particle dispersed in the above-mentioned water-insoluble matrix material and a process of performing detection of a polishing endpoint using an optical endpoint detector.

EFFECTS OF THE INVENTION

According to the polishing pad for a semiconductor wafer of the first and second aspects of the invention and the laminated body for polishing of a semiconductor wafer equipped with the same, optical detection of a polishing endpoint can be easily performed without lowering the polishing performance in polishing. In particular, according to the polishing pad of the first aspect of the invention, not only a polishing endpoint but also the all polishing situations can be always observed optically during polishing.

According to the method for polishing of a semiconductor wafer of the invention, the semiconductor wafer can be effectively polished while observing the polishing situation, and the semiconductor wafer is not polished excessively.

DETAILED DESCRIPTION OF THE INVENTION

The polishing pad for a semiconductor wafer (hereinafter also referred to as "polishing pad") of the first aspect of the invention is characterized in that it is comprised of a water-insoluble matrix material and a water-soluble particle dispersed in the above-mentioned water-insoluble matrix material, and has light transmitting properties.

The "water-insoluble matrix material" constituting the polishing pad for a semiconductor wafer according to the first aspect of the invention has a role in maintaining a shape of the polishing pad and retaining water-soluble particles in the polishing pad.

Materials forming the water-insoluble matrix material are not particularly limited as long as they can give light transmitting properties to the polishing pad, but include thermoplastic resin, thermosetting resin, elastomer, rubber and the like. These may be used alone or in combination of two or more.

Examples of the thermoplastic resin include polyolefin-based resin, polystyrene-based resin, polyacrylic-based resin such as (meth)acrylate-based resin, vinyl ester resin except for polyacrylic-based resin, polyester-based resin, polyamide-based resin, fluorine resin, polycarbonate resin, polyacetal resin and the like. These may be used alone or in combination of two or more.

Examples of the thermosetting resin include phenol resin, epoxy resin, unsaturated polyester resin, polyurethane resin, polyurethane urea resin, urea resin, silicone resin and the like. These may be used alone or in combination of two or more.

Examples of the elastomer include thermoplastic elastomers, silicone resin-based elastomer, fluorine resin-based elastomer and the like. The thermoplastic elastomers may be used styrene-based elastomer such as styrene-butadiene-styrene block copolymer (SBS), hydrogenated block copolymer thereof (SEBS), polyolefin elastomer (TPO), thermoplastic polyurethane elastomer (TPU), thermoplastic polyester elastomer (TPEE), polyamide elastomer (TPAE), diene-based elastomers such as 1,2-polybutadiene, and the like. These may be used alone or in combination of two or more.

Examples of the rubber include butadiene rubber, styrene-butadiene rubber, isoprene rubber, isobutylene-isoprene rubber, acrylic rubber, acrylonitrile-butadiene rubber, ethylene-propylene rubber, ethylene-propylene-diene rubber, silicone rubber, fluorine rubber and the like. These may be used alone or in combination of two or more.

These materials may be modified with an acid anhydride group, a carboxyl group, a hydroxyl group, an epoxy group, an amino group or the like. Modification can adjust the affinity and the like with a water-soluble particle, an abrasive, an aqueous medium and the like. In addition, these modified materials can be also used in combination of two or more.

In addition, although the water-insoluble matrix material may be a crosslinked polymer or a non-crosslinked polymer, it is preferable that at least a part of the matrix material is a crosslinked polymer. When the water-insoluble matrix material is formed of two or more materials, at least a part of any one material may be a crosslinked polymer.

At least a part of the water-insoluble matrix material having a crosslinking structure can give the elastic recovering force to a polishing pad. Therefore, a displacement by a shearing stress applied to the polishing pad during polishing can be suppressed less, and pores in which a water-soluble particle was formed by dissolving or dropping off are prevented from being buried due to plastic deformation by excess stretching of the water-insoluble matrix material during both polishing and dressing. In addition, the surface of the polishing pad can be prevented from excessively fuzzing. For this reason, the slurry is well retained during polishing, the retaining property of the slurry by dressing is easily recovered and, further scratching can be prevented from occurring.

Examples of the crosslinked polymer include ones obtained by crosslinking resins such as polyurethane resin, epoxy resin, polyacrylic-based resin, unsaturated polyester resin, vinyl ester resin except for a polyacrylic resin, diene-based elastomers such as 1,2-polybutadiene, and rubbers such as butadiene rubber, isoprene rubber, acrylic rubber, acrylonitrile-butadiene rubber, styrene-butadiene rubber, ethylene-propylene rubber, silicone rubber, fluorine rubber, styrene-isoprene rubber, polyethylene, poly(fluorinated vinylidene) and the like with irradiation of an ultraviolet-ray or an electoron beam in the presence of a crosslinking agent. Besides, ionomer and the like may be used.

Among these crosslinked polymers, crosslinked 1,2-polybutadiene is particularly preferable because it can give the sufficient light transmitting properties, is stable to a strong acid or a strong alkali contained in many slurries and, further, is hardly softened due to water absorption. This crosslinked 1,2-polybutadiene can be used by blending with other rubbers such as butadiene rubber and isoprene rubber.

A method of giving the light transmitting properties to the polishing pad is not particularly limited but can be impaired, for example, by controlling the crystallinity or the like. In addition, as long as the above-mentioned water-insoluble matrix material can give the light transmitting properties (whether the visible light is transmitted or not), the material itself needs not to be transparent (including translucent). It is preferable that the light transmitting properties are higher. It is more preferable that the material is transparent.

Such the water-insoluble matrix material can render the residual elongation after breaking (hereinafter simply referred to as "break residual elongation") 100% or less when a test piece formed by the water-insoluble matrix material is broken at 80° C. according to JIS K 6251. That is, a water-insoluble matrix material can be obtained in which a total distance between gazes in a test piece after breaking is 2 or less-fold a distance between gazes before breaking. In addition, this break residual elongation is preferably 30% or less, more preferably 10% or less, particularly preferably 5% or less. The break residual elongation is usually 0% or greater. As the break residual elongation is exceeding 100%, fine fragments scratched or elongated from the surface of a polishing pad during polishing and surface updating tend to easily clog pores.

A break residual elongation is an elongation obtained by subtracting a distance between marks before test from the total of the two distance between respective marks and broken parts of broken and divided test pieces, when a test piece is broken in a tensile test at a test piece shape of dumbbell No. 3, a tensile rate of 500 mm/min. and a test temperature of 80° C. according to JIS K 6251 "Tensile test method on a vulcanized rubber". Regarding a test temperature, since a temperature obtained by gliding in actual polishing is around 80° C., the test was performed at this temperature.

The "water-soluble particle" constituting the polishing pad of the first aspect of the invention is a particle which is dispersed in the above-mentioned water-insoluble matrix material, dissolved or swollen by contact with an aqueous medium supplied from the outside in polishing and is dropped off the surface of a polishing pad (due to dissolution or swelling), and can form a pore which can retain the slurry in the vacant place after dropping off and can make wastages reside transiently.

The above-mentioned water-soluble particle is not particularly limited but a variety of materials can be used. For example, an organic-based water-soluble particle and an inorganic-based water-soluble particle may be used. As the organic-based water-soluble particle, particles composed of sugars such as dextrin, cyclodextrin, mannitol and lactose, celluloses such as hydroxypropylcellulose and methylcellulose, starch, protein, polyvinyl alcohol, polyvinyl pyrrolidone, polyacrylic acid, polyethylene oxide, water-soluble photosensitive resin, sulfonated polyisoprene, sulfonated polyisoprene copolymer and the like may be used. As the inorganic-based water-soluble particle, particles composed of potassium sulfate, potassium acetate, potassium nitrate, potassium carbonate, potassium hydrogencarbonate, potassium chloride, potassium bromide, potassium phosphate, magnesium nitrate and the like may be used. Among them, cyclodextrin and potassium sulfate are preferred. These water-soluble particles composed of these respective components may be used alone or in combination of two or more. Further, organic-based and inorganic-based water-soluble materials may be used in combination.

A shape of the above-mentioned water-soluble particle is not particularly limited but is preferably near spherical, more preferably spherical. In addition, it is preferable that respective water-soluble particles are similar in a shape. This makes shapes of formed pores uniform and, thus, better polishing can be performed.

In addition, a size of the above-mentioned water-soluble particle is not particularly limited but is, usually, 0.1 to 500 $\mu$m, more preferably 0.5 to 100 $\mu$m, most preferably 1 to 80 $\mu$m. When the particle size is less than 0.1 $\mu$m, a size of a pore is smaller than that of an abrasive in some times and an abrasive is not sufficiently retained in a pore in some times, being not preferable. On the other hand, when the particle size exceeds 500 $\mu$m, the size of a formed pore becomes too large, and there is a tendency that the mechanical strength of the polishing pad and the removal rate are lowered.

An amount of the above-mentioned water-soluble particle contained in a polishing pad is preferably 10 to 90% by volume, more preferably 15 to 60% by volume, further preferably 20 to 40% by volume based on 100% by volume of the total amount of the water-insoluble matrix material and the water-soluble particle. When the content of the water-soluble particle is less than 10% by volume, a sufficient amount of pores are not formed, and a removal rate tends to be lowered. On the other hand, when the content exceeds 90% by volume, there is a tendency that not only water-soluble particles exposed on the surface of a polishing pad but also water-soluble particles existing in the interior thereof can be prevented from dissolving or swelling with difficulty. Therefore, it becomes difficult to retain the hardness and the mechanical strength of a polishing pad at an appropriate value during polishing.

In addition, it is preferable that only water-soluble particles exposed on the surface of a polishing pad are dissolved in water, and water-soluble particles existing in the interior of the polishing pad without emerging on the surface do not absorb a moisture and are not swollen. For this reason, an outer shell composed of epoxy resin, polyimide, polyamide, polysilicate and the like for inhibiting moisture absorption may be formed on at least a part of an outermost part of the water-soluble particle.

The above-mentioned water-soluble particle has the function of increasing an indentation hardness of a polishing pad, in addition to the function of forming a pore during polishing. For example, a preferable Shore D hardness is 35 to 100. This large indentation hardness can increase a pressure loaded on the surface to be polished by using a polishing pad and can enhance a removal rate and, at the same time, the high flatness can be obtained. Therefore, it is preferable that this water-soluble particle is a solid particle which can retain a sufficient indentation hardness in a polishing pad.

A method of dispersing the above-mentioned water-soluble particle in the water-insoluble matrix material is not particularly limited. Usually, a material constituting the above-mentioned water-insoluble matrix material, a water-soluble particle and other additives are kneaded. In this kneading, a material constituting the water-insoluble matrix material is kneaded while heating so as to be easily processed. It is preferable that the water-soluble particle is solid at kneading temperature. When the particle is solid, the water-soluble particle is easily dispersed in the state where the above-mentioned preferable average particle size is retained, regardless of a magnitude of the compatibility with the above-mentioned material constituting the water-insoluble matrix material. Therefore, it is preferable that a kind of water-soluble particle is selected depending upon a processing temperature for a material constituting the used water-insoluble matrix material.

The polishing pad of the first aspect of the invention may contain, in addition to the above-mentioned water-insoluble matrix material and water-soluble particle, an abrasive, an oxidizing agent, a hydroxide of an alkali metal, an acid, a pH adjusting agent, a surfactant, a scratching preventing agent and the like which have previously been contained in the slurry, at such an amount range that the light transmitting properties can be maintained. This makes possible to perform polishing by supplying only water during polishing.

In order to render better the affinity between the water-insoluble matrix material and the water-soluble particle, as well as the dispersity of the water-soluble particle contained in the water-insoluble matrix material, a compatibilizing agent may be incorporated. Examples of the compatibilizing agent include polymers, block copolymers and random copolymers, which are modified with acid anhydride group, carboxyl group, hydroxyl group, epoxy group, oxazoline group, amino group and the like, as well as a variety of nonionic surfactants, coupling agents and the like. These may be used alone or in combination of two or more.

Further, the polishing pad of the first aspect of the invention may contain a variety of additives such as a filler, a softening agent, an antioxidant, an ultraviolet absorbing agent, an antistatic agent, a lubricant, a plasticizer and the like, as option. Alternatively, reactive additives such as sulfur, peroxide and the like may be added to the polishing pad, which can be reacted and crosslinked.

Examples of the filler include materials for improving the rigidity such as calcium carbonate, magnesium carbonate, talc, clay and the like, and materials having the polishing effects such as silica, alumina, ceria, zirconia, titania, manganese dioxide, dimanganese trioxide, barium carbonate and the like. These may be used alone or in combination of two or more.

The polishing pad of the first aspect of the invention can be prepared by introducing a composition comprising the above-mentioned respective components into a mold having a prescribed shape.

The polishing pad of the first aspect of the invention can retain the slurry in pores and, further, can make wastages reside transiently. A planar shape of the polishing pad is not particularly limited but can be circle such as discs or polygon such as square (belt-like, roller-like). In addition, a size thereof is not particularly limited. For example, in the case of a disc, a diameter can be 500 to 900 mm.

A thickness of the polishing pad of the first aspect of the invention may be depending upon the use and is usually 0.5 mm or larger, preferably 1 to 3 mm. A thickness of the polishing pad may be constant, or may be partially different. Upon detection of a polishing endpoint with the light, considering the nature that, when the light is transmitted through an object having the light transmitting properties, the intensity of the light is generally declined in proportion to square of a length of an object through which the light transmits, at least a part of a polishing pad may be provided with a part through which the light easily transmits. For doing so, for example, by thinning a part, a polishing endpoint of which is detected with the light, the transmittance can be remarkably improved and, further, the detection sensitivity is improved. Further, at a part other than this thin part, even when the light having the sufficient intensity for detecting an endpoint is difficult to be transmitted, the intensity of the light sufficient for detecting an endpoint can be maintained at a thin part.

Therefore, it is preferable that a polishing pad has a thin part. This thin part is specifically a part which is molded thinner than a maximum thickness of the polishing pad (see FIGS. 1, 2, 3 and 4). A planar shape of this thin part is not particularly limited but may be circle, fan-shaped, polygon such as square, rectangle and trapezoid, annulus and the like. In addition, a cross-sectional shape of the thin part may be, for example, polygon such as square and pentagon, dome shape or other shape (see FIGS. 1, 2, 3 and 4). In each view, an upper side is a polishing side. In addition, a size of a thin part is not particularly limited. For example, in the case of circle, a diameter of 20 mm or more is preferable. In the case of annulus, a width of 20 mm or more is preferable. In the case of rectangle, longitudinal 30 mm or more and transverse 10 mm or more is preferable.

Further, the number of thin parts provided on a polishing pad is not particularly limited but may be 1 or 2 or more. A position of the thin part is not particularly limited. For example, in the case where one thin part is provided, the part may be provided on a place as in FIG. 5 and FIG. 6. Further, in the case where 2 or more thin parts are provided, the parts may be arranged at the concentric form (see FIG. 7).

A thickness of this thin part is not particularly limited. Usually, the thinnest thickness in a thin part is preferably 0.1 mm or more, more preferably 0.3 mm or more. Usually, that thickness is 3 mm or less. When the thickness is less than 0.1 mm, there is a tendency that it becomes difficult to sufficiently retain the mechanical strength at this part.

Further, although the above-mentioned thin part may be formed by concave notching a polishing side of the polishing pad (see FIG. 2), it is preferable that a back side is formed by concave shape (see FIG. 1). By concave shape of a back side, the better light transmitting properties can be obtained without affecting the polishing performance.

Besides concave notching of this thin part, grooves may be formed at a prescribed width (for example, 0.1 to 2 mm), depth and intervals, or dot pattern may be provided, on a polishing side of the polishing pad, if necessary. This can improve the slurry retaining properties and the used slurry draining properties. These grooves and dot pattern may be arranged by a prescribed form such as concentric form, grid form, vortex form, radial form and the like. Alternatively, a concave part obtained by concave notching for forming the above-mentioned thin part may play a role also as those grooves and dot pattern.

The above-mentioned "light transmitting properties" is not particularly limited as far as the light can be transmitted. It is preferable that, in the case where a thickness of a polishing pad is 2 mm, a light transmittance at a wavelength between 100 and 3000 nm is 0.1% or more, or an integrated transmittance in a wavelength range between 100 and 3000 nm is 0.1% or more. This transmittance or integrated transmittance is preferably 1% or more, more preferably 2% or more. However, this transmittance or integrated transmittance may not be higher than that as required. Usually, it may be 50% or less, further 30% or less, particularly 20% or less.

In addition, in a polishing pad used for polishing using an optical endpoint detector, it is preferable that the light transmittance at a wavelength ranges between 400 and 800 nm which is a region most frequently used as the endpoint detecting light is high. For this reason, it is preferable that, in the case where a thickness is 2 mm, the light transmittance at a wavelength between 400 and 800 nm is 0.1% or more (more preferably 1% or more, more preferably 2% or more, particularly preferably 3% or more, usually 50% or less), or the integrated transmittance at a wavelength range between 400 and 800 nm is 0.1% or more (more preferably 1% or more, more preferably 2% or more, particularly preferably 3% or more, usually 50% or less).

This transmittance or integrated transmittance may not be higher than that as required. Usually, it is 20% or less, may be further 10% or less, particularly 5% or less.

This transmittance is a value by measuring a light transmittance of a test piece having a thickness of 2 mm with a UV absorbance measuring device which can measure the absorbance at a prescribed wavelength. The integrated transmittance can be obtained by integrating the transmittance at a prescribed wavelength region measured similarly.

The polishing pad for a semiconductor wafer of the second aspect of the invention is characterized in that it is comprised of a substrate for a polishing pad provided with a through hole penetrating from surface to back, and a light transmitting part fitted in the above-mentioned through hole, wherein the above-mentioned light transmitting part comprises a water-insoluble matrix material and a water-soluble particle dispersed in the above-mentioned water-insoluble matrix material.

The "substrate for a polishing pad" according to the second aspect has the polishing performance by itself, and can retain the slurry on the surface thereof and, further, make wastages reside transiently. The transmitting properties of this substrate for a polishing pad may be present or absent. In addition, a planar shape thereof is not particularly limited but may be circle or polygon such as square. A size thereof is not particularly limited.

In order to retain the slurry and make wastages reside transiently during polishing, it is preferable that at least fine holes or grooves are formed on the surface of the above-mentioned substrate for a polishing pad. That is, fine holes and/or grooves may be pre-formed on the above-mentioned substrate for a polishing pad (for example, foamed body and the like), or pores and/or grooves may be formed on the substrate by dropping off during polishing. As the latter, a substrate for a polishing pad wherein a water-soluble material having a prescribed shape such as particulate form, linear form and the like dispersed in a water-insoluble matrix material may be used. By making a polishing pad provided with such the substrate for a polishing pad in contact with an aqueous medium during polishing, a water-soluble material is dissolved or dropped off, whereby, pores and/or grooves are formed on the surface of the substrate for a polishing pad.

A material constituting the above-mentioned substrate for a polishing pad is not particularly limited but a variety of materials can be used. In particular, it is preferable that an organic material is used because it is easily molded into a prescribed shape and nature and can give the suitable elasticity. As this organic material, foaming materials, and a variety of materials constituting a light transmitting part described later may be used. A material constituting the above-mentioned substrate for a polishing pad and a material constituting a light transmitting part may be the same or different.

A thickness of a substrate for a polishing pad of the second aspect of the invention may depend upon the use and is usually 0.5 mm or more, preferably 1 to 3 mm. The thickness of the substrate for a polishing pad may be constant overall or may be partially different.

The "through hole" penetrates the substrate for a polishing pad from the surface to the back and a light transmitting part is fitted in this through hole. The above-mentioned through hole may be provided at any position of the substrate for a polishing pad, for example, at a center, or at an end, or an end of the substrate for a polishing pad may be formed a vacancy part. A shape of the above-mentioned through hole is not particularly limited but, for example, a planar shape of an opening thereof may be circle, fan-shaped, polygon such as square and trapezoid, annulus and the like. In addition, a cross-sectional shape of the above-mentioned through hole may be, for example, T-letter shape, reverse T-letter shape, square or other shape (see FIGS. 8, 9, 10 and 11, In each figure, No. 12 represents a substrate for a polishing pad and No. 13 represents a through hole. Figures show that an upper side in each view is a polishing side.). Among them, a T-letter shape is particularly preferable.

A size of one of the through holes is not particularly limited. Usually, in the case where an opening is circle, it is preferable that a diameter is 20 mm or more (usually, ⅔ of a radius of a polishing pad or less). In the case of an annular through hole, it is preferable that a width thereof is 20 mm or more (usually, ⅔ of a radius of a polishing pad or less). In the case of square, vertical length of 30 mm or more (usually, ⅔ of a radius of a polishing pad or less) and horizontal length of 10 mm or more (usually, ⅔ of a radius of a polishing pad or less) are preferable. When each through hole becomes smaller than the above description, it may become difficult in some cases to assuredly transmit the light such as the endpoint detecting light. Besides, the number of through holes is not particularly limited.

The "light transmitting part" refers to a part that has the light transmitting properties for making detection of a polishing endpoint easy and is fitted in the above-mentioned through hole.

The above-mentioned light transmitting part comprises a water-insoluble matrix material and a water-soluble particle dispersed in this water-insoluble matrix material.

As a material for forming a water-insoluble matrix material constituting the above-mentioned light transmitting part, parts exemplified as a material for forming the water-insoluble matrix material with respect to the first aspect of the invention can be preferably used. Therefore, it is preferable that a water-insoluble matrix material constituting the above-mentioned light transmitting part is composed of at least a crosslinked polymer. It is also preferable that the crosslinked polymer is crosslinked 1,2-polybutadiene.

A water-soluble particle constituting the above-mentioned light transmitting part is not particularly limited. Considering the property which can be exerted at a magnitude of the light transmitting part, the water-soluble particle relating to the first aspect of the invention can be preferably used. That is, the same kind, shape and construction as those of the water-soluble particle relating to the first aspect of the invention may be used. In addition, as described above, an outer shell composed of epoxy resin, polyimide, polyamide, polysilicate or the like may be formed on the surface of the above-mentioned water-soluble particle.

The above-mentioned water-soluble particle has the function of compatiblizing an indentation hardness of a light transmitting part with that of other parts of a polishing pad, in addition to the function of forming a pore during polishing. In order to increase a pressure loaded during polishing, enhance a removal rate, and obtain high flatness, it is preferable that a Shore D hardness is 35 to 100 throughout the polishing pad. However, it is difficult in some cases to obtain a desired Shore D hardness from only a material constituting the above-mentioned water-insoluble matrix material. In such a case, by inclusion of the above-mentioned water-soluble particle, it becomes possible to include a Shore D hardness to the same extent as that of other parts of a polishing pad, as well as to form a pore. For such reasons, it is preferable that the above-mentioned water-soluble particle is a solid particle which can retain a sufficient indentation hardness in a polishing pad.

A shape of the above-mentioned light transmitting part is not particularly limited. A planar of a polishing side of a polishing pad usually depends on a shape of a through hole and usually is the same as a shape of a through hole, and may be circle or polygon as described above. In addition, a cross-sectional shape thereof is not particularly limited and is usually a shape, at least a part of which may be fitted in a through hole. For example, cross-sectional shapes as shown in FIGS. 12, 13, 14, 15, 16, 17, 18 and 19 may be used. FIG. 12 and FIG. 14 show a polishing pad in the state where a light transmitting part 14 having the same thickness as that of a substrate 12 for a polishing pad is completely fitted in a through hole. FIGS. 13, 15, 16, 17 and 19 show a polishing pad in the state where a light transmitting part 14 having a different thickness from that of a substrate 12 for a polishing pad is fitted in a through hole.

The above-mentioned light transmitting part may not be thinned as shown in FIG. 12, or may be thinned. Thinning is to make a thickness of a light transmitting part thinner than a maximum thickness of a substrate for a polishing pad as shown in FIGS. 13, 15, 16, 17 and 19. Alternatively, thinning includes molding by thinning a part of the above-mentioned light transmitting part through which the light transmits in the light transmitting part itself as shown in FIG. 18.

The nature of the above-mentioned light transmitting part is the same as that of the thin part according to the first aspect of the invention.

Therefore, by using a thin light transmitting part, the light transmitting properties can be remarkably improved, and it is possible to make detection of a polishing endpoint easy, provided that, a thickness of the above-mentioned light transmitting part is preferably 0.1 mm or more, more preferably 0.3 mm or more, usually 3 mm or less. When the thickness is less than 0.1 mm, there is a tendency that it becomes difficult to sufficiently retain the mechanical strength of a light transmitting part.

The number of the above-mentioned light transmitting parts is not particularly limited but may be 1 or 2 or more depending upon the number of through holes. In addition, arrangement of the part is also not particularly limited. For example, when one light transmitting part is provided, it can be arranged as shown in FIG. 20 and FIG. 21. Further, when 2 or more light transmitting parts are provided, they may be arranged concentrically as shown in FIG. 22.

A method of obtaining a water-insoluble matrix material in which a water-soluble particles are dispersed is not particularly limited. According to the same manner as that for the polishing pad of the first aspect of the invention, the water-insoluble matrix material can be obtained by kneading a mixture of a material constituting a water-insoluble matrix material, a water-soluble particle and other additives.

Upon preparation of a light transmitting part, in addition to a material constituting a water-insoluble matrix material and a water-soluble particle, a compatiblizing agent (polymers modified with acid anhydride group, carboxyl group, hydroxyl group, epoxy group, oxazoline group, amino group, block copolymers, random copolymers or the like) for improving the affinities of them and the dispersity in a water-soluble particle containing in a water-insoluble matrix material, a nonionic surfactant, a coupling agent and residues thereof may be contained.

Both the substrate for a polishing pad and the light transmitting part constituting the polishing pad of the second aspect of the invention may contain an abrasive, an oxidizing agent, a hydroxide of an alkali metal, an acid, a pH adjusting agent, a surfactant, a scratching preventing agent and the like, which have previously been contained therein, in such a range that the light transmitting properties can be maintained.

Furthermore, various additives such as a filler, a softening agent, an antioxidant, an ultraviolet absorbing agent, an antistatic agent, a lubricant, a plasticizer and the like may be contained. In particular, as the filler, materials for improving the rigidity such as calcium carbonate, magnesium carbonate, talc, clay and the like, and materials having the abrading effects such as silica, alumina, ceria, zirconia, titania, manganese dioxide, dimanganese trioxide, barium carbonate and the like may be used.

A concave part in which a light transmitting part is not existed in the through hole formed by thinning (see FIG. 13) and that of the light transmitting part (see FIG. 18) may be formed in which side of one side and the reverse side. Forming a concave part on the backside makes thickness of the light transmitting part thinner considering no effect of polishing properties.

The laminated body for polishing of a semiconductor wafer 7 of the invention is characterized in that comprising a polishing pad for a semiconductor as described above and a supporting layer 15 laminated on a backside of the above-mentioned polishing pad, wherein the above-mentioned laminated body has transmitting properties in a laminated direction (see FIG. 23).

The supporting layer is a layer to be laminated on the backside which is a side opposite the polishing surface of a polishing pad. A planar shape of the supporting layer is not particularly limited but may be circle, polygon such as square, and the like, and is usually the same planar shape as that of the polishing pad. In the case the supporting layer has a part ensuring the transmitting properties by vacancy, the part may not be considered. In addition, this supporting layer may be one layer, or a laminate of two or more layers. Further, in the case where two or more supporting layers are laminated, respective layers may be composed of the same components, or may be composed of the different components.

A thickness of the above-mentioned supporting layer is not particularly limited but is usually 0.1 to 2 times as thick as a polishing pad. In addition, a hardness of the above-mentioned supporting layer is not particularly limited. However, by adopting a Shore D hardness of, preferably, 10 to 80, more preferably 20 to 50, even when a Shore D hardness of the polishing pad of the first aspect of the invention or that of the substrate for a polishing pad of the second aspect of the invention is as high as 60 to 90, a laminated body has the sufficient flexibility as a whole in polishing, and it can be appropriately adapted to the irregularity of the surface to be polished. A hardness of a supporting layer which is provided when the substrate for a polishing pad of the second aspect of the invention is used, is preferably smaller than that of the above-mentioned substrate for a polishing pad.

In the case where a supporting layer is provided in the polishing pad of the first and second aspects of the invention, it is preferable that at least a part used for detecting an endpoint of the supporting layer has the light transmitting properties. Therefore, a part of a supporting layer may be thinned and formed vacancy and, further, a part having the light transmitting properties may be provided on this vacancy part.

When a supporting layer having no light transmitting properties is used, methods of forming a vacancy at a part to be passed through the light and the like ensure the light transmitting properties of the laminated body for polishing.

A material constituting the above-mentioned supporting layer is not particularly limited but a variety of materials may be used. In particular, it is preferable that an organic material is used because it is easily molded into a prescribed shape and nature and also it can give the suitable elasticity. As this organic material, materials which are applied to a water-insoluble matrix material constituting the above-mentioned light transmitting part can be used, provided that, a material constituting the above-mentioned supporting layer and a material constituting a water-insoluble matrix material of the above-mentioned light transmitting part may be the same or different.

Since the polishing pads of the first and second aspects of the invention have the light transmitting properties, respectively, they can be used in a semiconductor wafer polishing apparatus equipped with an optical endpoint detector. In addition, a laminated body for polishing in which a supporting layer is laminated on the backside of the above-mentioned polishing pad can be also used in a semiconductor wafer polishing apparatus equipped with an optical endpoint detector, by provision of a part through which the light transmits by forming a vacancy part in the above-mentioned supporting layer. This optical endpoint detector is an apparatus which can observe the polishing situations with the light reflected on the surface of a material to be polished, and can detect a polishing endpoint. When a polishing pad or a laminated body for polishing has a disc-like shape, by provision of light transmitting parts at a center of this disc and concentrically on the disc in the ring-form, it becomes possible to polish while usually observing a polishing point. When this optical endpoint detector is used, polishing can be assuredly terminated at an optimal polishing endpoint without excess polishing, which is effective.

The method for polishing of a semiconductor wafer of the present invention is a method employing the above-mentioned polishing pad or laminated body for polishing and is characterized in comprising a process of performing detection of a polishing endpoint using an optical endpoint detector.

The "optical endpoint detector" can be the same as described above. In the method for polishing of a semiconductor wafer of the invention, for example, a polishing apparatus as shown in FIG. 24 may be used. That is, the polishing apparatus is an apparatus provided with a polishing pad 1, a rotatable surface plate 2 being capable of fixing the polishing pad 1 on, a pressure head 3 being capable of rotating and moving in vertical and horizontal directions, a slurry supplying part 5 which can drop the slurry on the surface plate at a constant amount per unit time, and an optical endpoint detector 6 mounted under the surface plate.

In this polishing apparatus, a polishing pad (or a laminated body for polishing) 1 of the present invention is fixed on the surface plate. On the other hand, a semiconductor wafer 4 is fixed on a lower end side of a pressure head 3, and this semiconductor wafer 4 is abutted against the polishing pad 1 while pushing with a prescribed pressure. Then, while a prescribed amount of the slurry is added dropwise on the surface plate from the slurry supplying part 5, the surface plate 2 and the pressure head 3 are rotated to slide the semiconductor wafer 4 and the polishing pad 1, to perform polishing.

Upon this polishing, the endpoint detecting light $R_1$ having a prescribed wavelength or a wavelength region is irradiated to the surface to be polished of the semiconductor wafer through the polishing pad of the first aspect of the invention or the light transmitting part according to the second aspect of the invention, from a lower side of the surface plate 2(the endpoint detecting light can transmit the surface plate when the surface plate itself has the light transmitting properties or a vacancy part is formed at a part of surface plate), from an optical endpoint detector 6. Then, the reflected light $R_2$ which is this endpoint detective light reflected on the surface of the semiconductor wafer 4 to be polished is captured by the optical endpoint detector 6, and polishing can be performed while observing the situations of the surface to be polished from this reflected light.

The above-mentioned slurry means an aqueous dispersion containing at least an abrasive. However, the slurry or only an aqueous medium without abrasive may be supplied from the outside during polishing. When only an aqueous medium is supplied, for example, the slurry can be formed by mixing an abrasive released from the interior of the polishing pad and the aqueous medium during polishing.

According to the method for polishing of a semiconductor wafer of the invention, the semiconductor wafer can be polished while usually observing the polishing situation, and the polishing can be done assuredly at an optimal polishing endpoint.

EXPLANATION OF SYMBOLS

Figure 1:
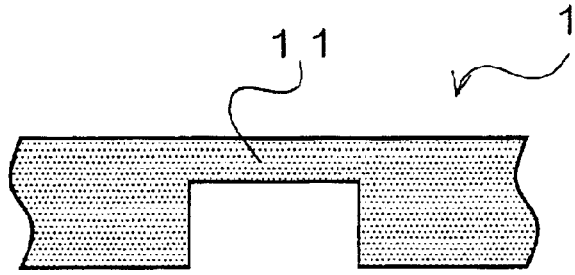
FIG. 1 is a schematic view showing one example of a cross-section in a thin part of a polishing pad of the present invention.
Figure 2:
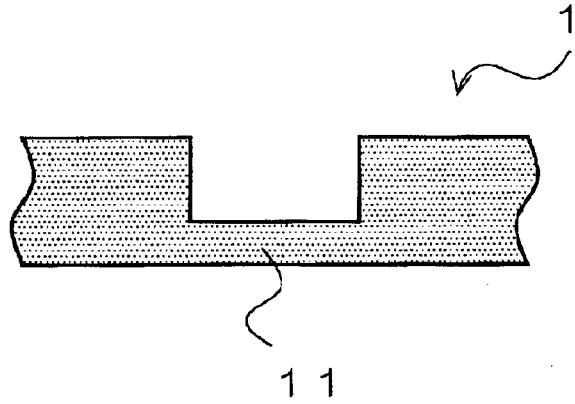
FIG. 2 is a schematic view showing one example of a cross-section in a thin part of a polishing pad of the present invention.
Figure 3:
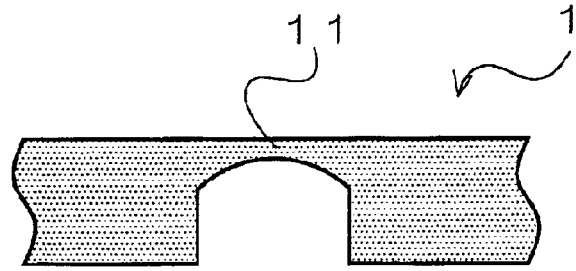
FIG. 3 is a schematic view showing one example of a cross-section in a thin part of a polishing pad of the present invention.
Figure 4:
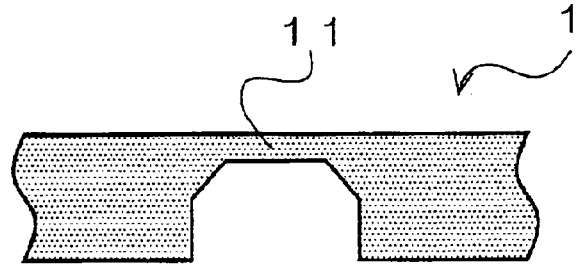
FIG. 4 is a schematic view showing one example of a cross-section in a thin part of a polishing pad of the present invention.
Figure 5:
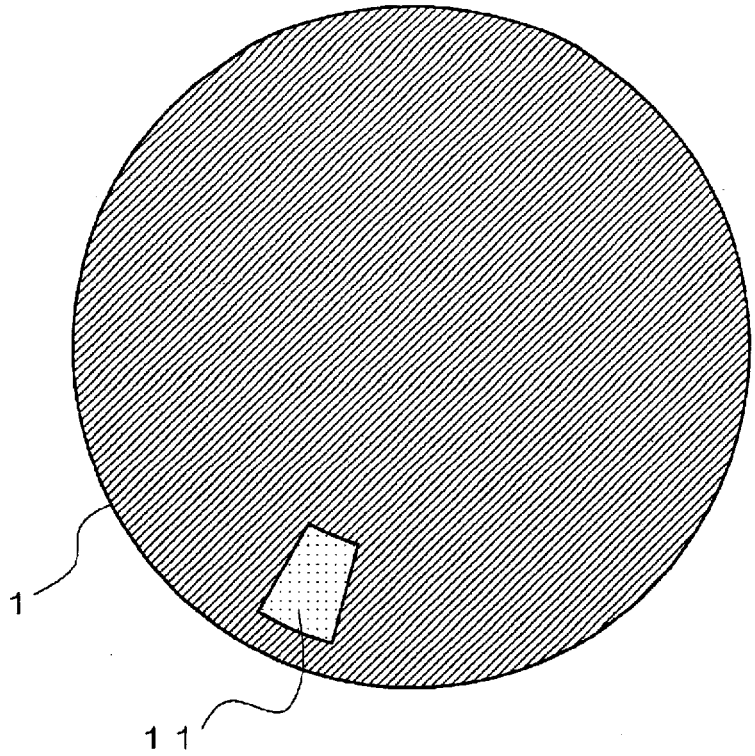
FIG. 5 is a schematic view seen from a back direction, showing one example of a planar shape of a thin part in the present invention.
Figure 6:
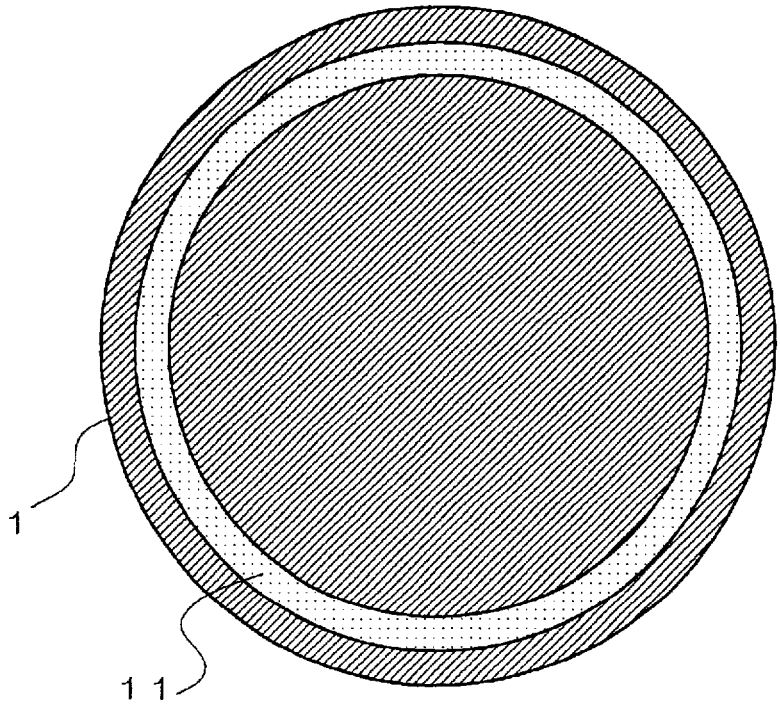
FIG. 6 is a schematic view seen from a back direction, showing one example of a planar shape of a thin part in the present invention.
Figure 7:
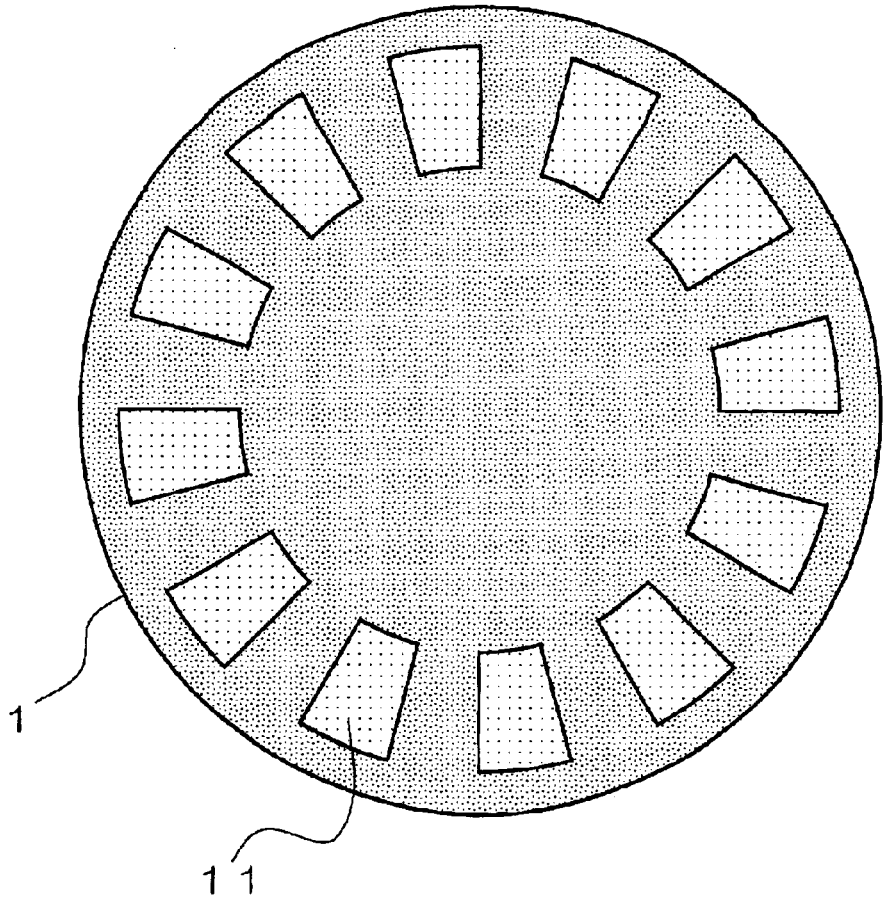
FIG. 7 is a schematic view seen from a back direction, showing one example of a planar shape of a thin part in the present invention.
Figure 8:
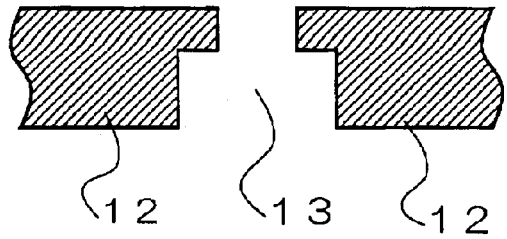
FIG. 8 is a cross-sectional schematic view showing one example of a through hole formed in a polishing pad.
Figure 9:
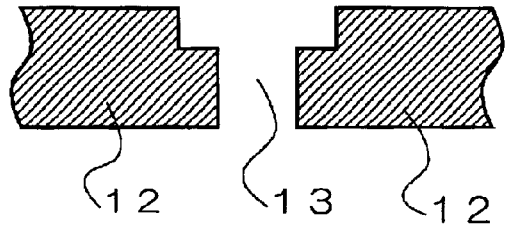
FIG. 9 is a cross-sectional schematic view showing one example of a through hole formed in a polishing pad.
Figure 10:
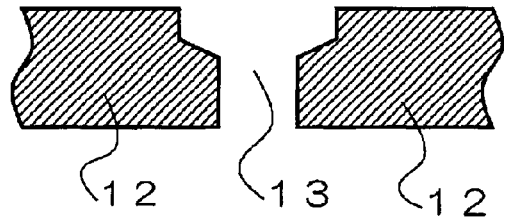
FIG. 10 is a cross-sectional schematic view showing one example of a through hole formed in a polishing pad.
Figure 11:
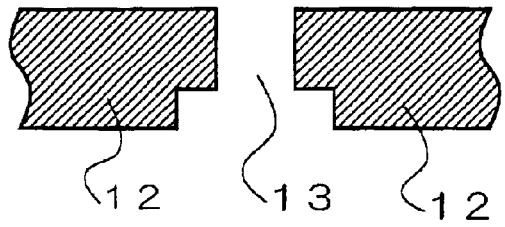
FIG. 11 is a cross-sectional schematic view showing one example of a through hole formed in a polishing pad.
Figure 12:
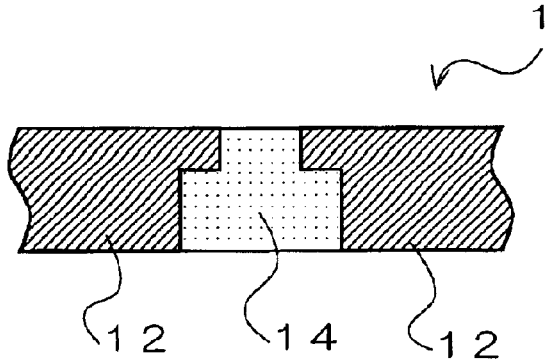
FIG. 12 is a schematic view showing an example of a shape and the fitted state of a substrate for polishing pad and a light transmitting part.
Figure 13:
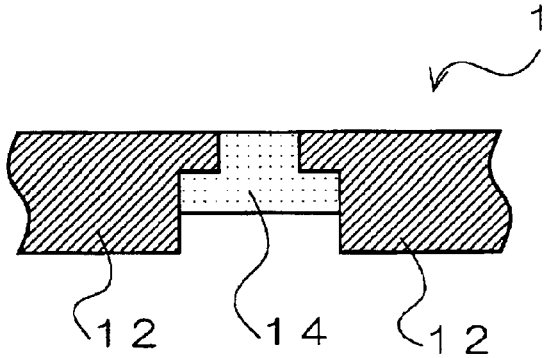
FIG. 13 is a schematic view showing an example of a shape and the fitted state of a substrate for polishing pad and a light transmitting part.
Figure 14:
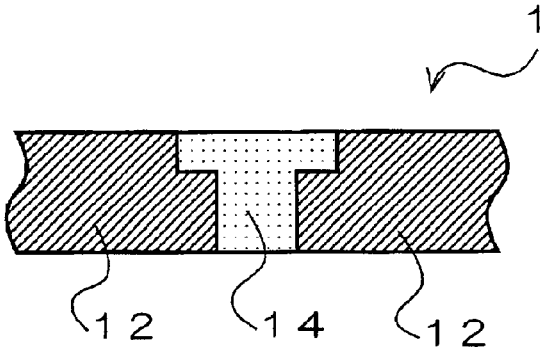
FIG. 14 is a schematic view showing an example of a shape and the fitted state of a substrate for polishing pad and a light transmitting part.
Figure 15:
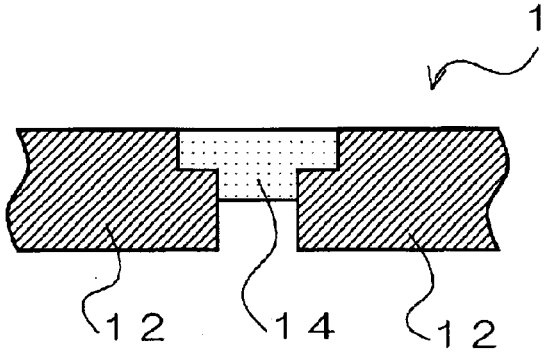
FIG. 15 is a schematic view showing an example of a shape and the fitted state of a substrate for polishing pad and a light transmitting part.
Figure 16:
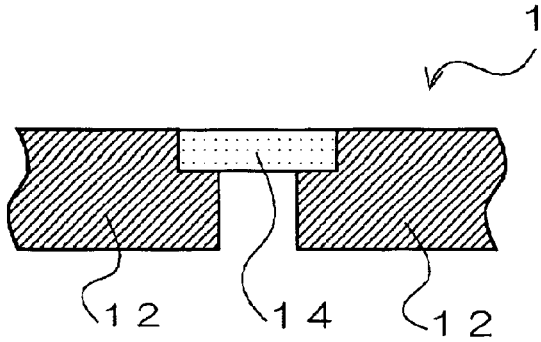
FIG. 16 is a schematic view showing an example of a shape and the fitted state of a substrate for polishing pad and a light transmitting part.
Figure 17:
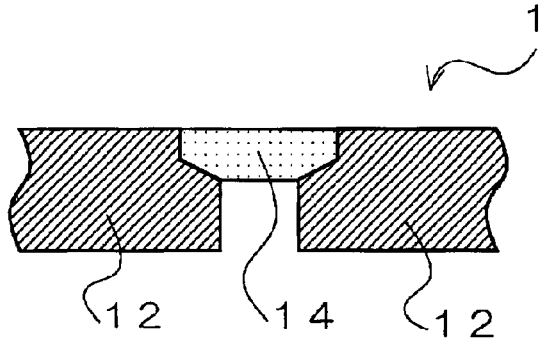
FIG. 17 is a schematic view showing an example of a shape and the fitted state of a substrate for polishing pad and a light transmitting part.
Figure 18:
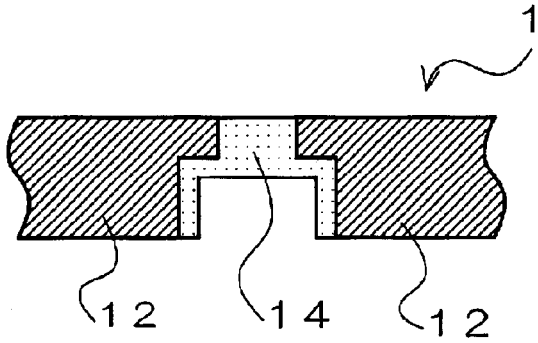
FIG. 18 is a schematic view showing an example of a shape and the fitted state of a substrate for polishing pad and a light transmitting part.
Figure 19:
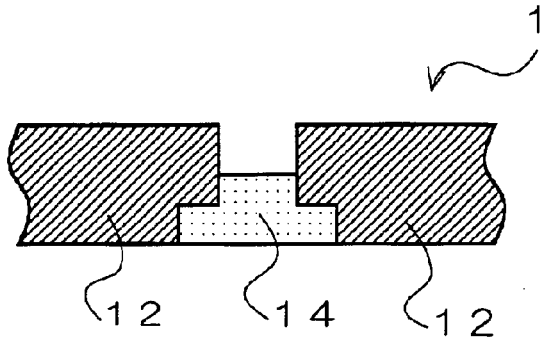
FIG. 19 is a schematic view showing an example of a shape and the fitted state of a substrate for polishing pad and a light transmitting part.
Figure 20:
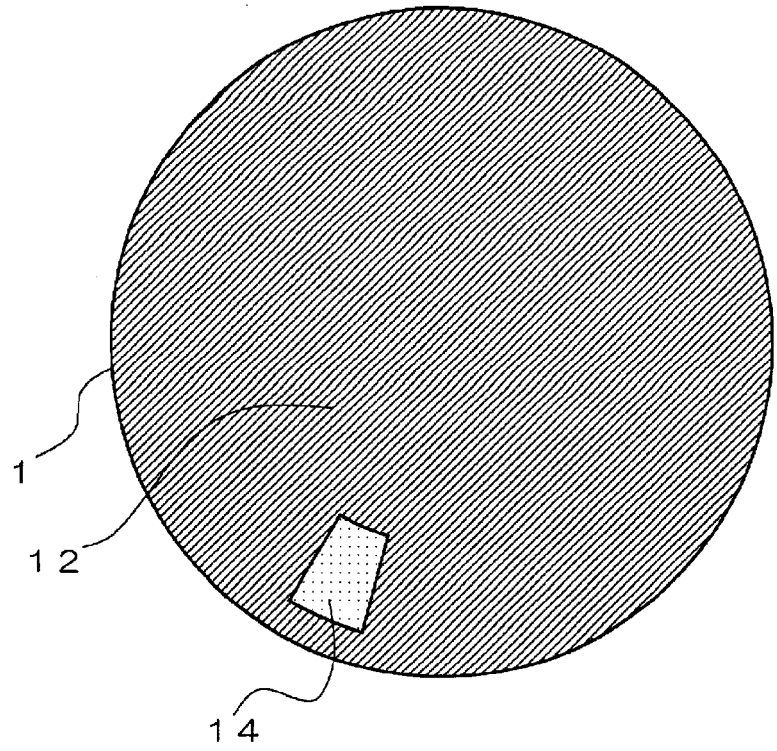
FIG. 20 is a schematic view showing an example of a polishing pad whose light transmitting part is fitted in a through hole of a substrate for polishing pad.
Figure 21:
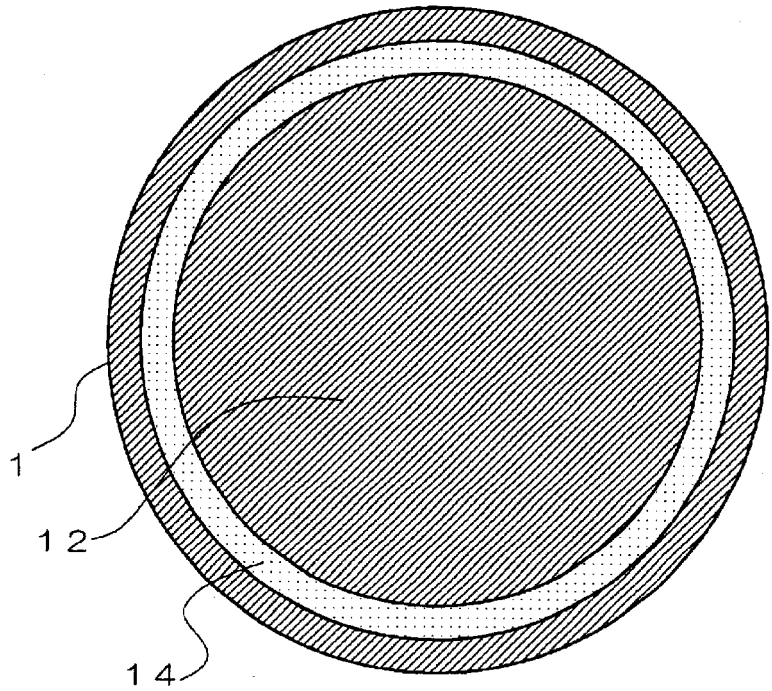
FIG. 21 is a schematic view showing an example of a polishing pad whose light transmitting part is fitted in a through hole of a substrate for polishing pad.
Figure 22:
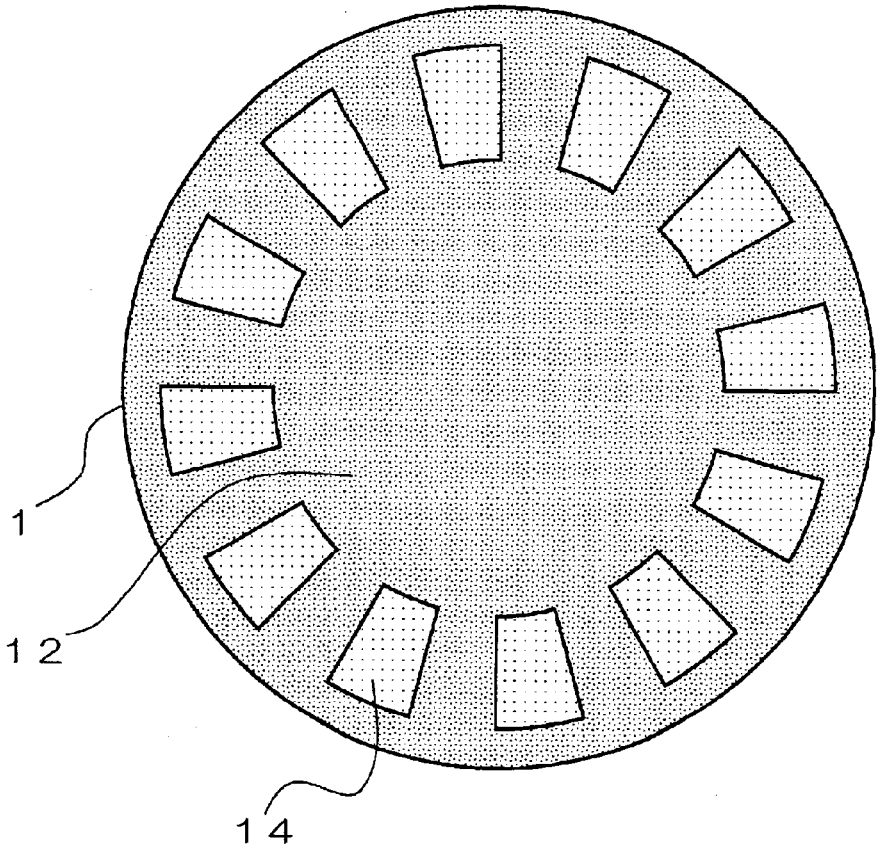
FIG. 22 is a schematic view showing an example of a polishing pad whose light transmitting part is fitted in a through hole of a substrate for polishing pad.
Figure 23:
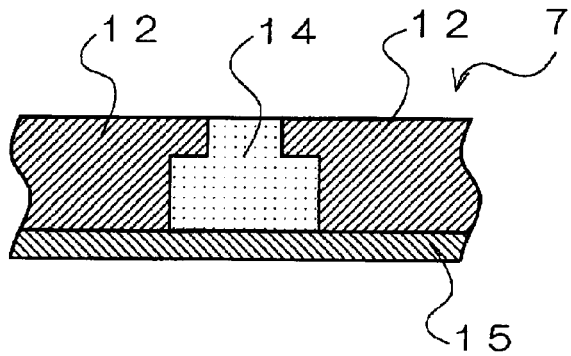
FIG. 23 is a cross-sectional schematic view showing one example of a laminated body for polishing.
Figure 24:
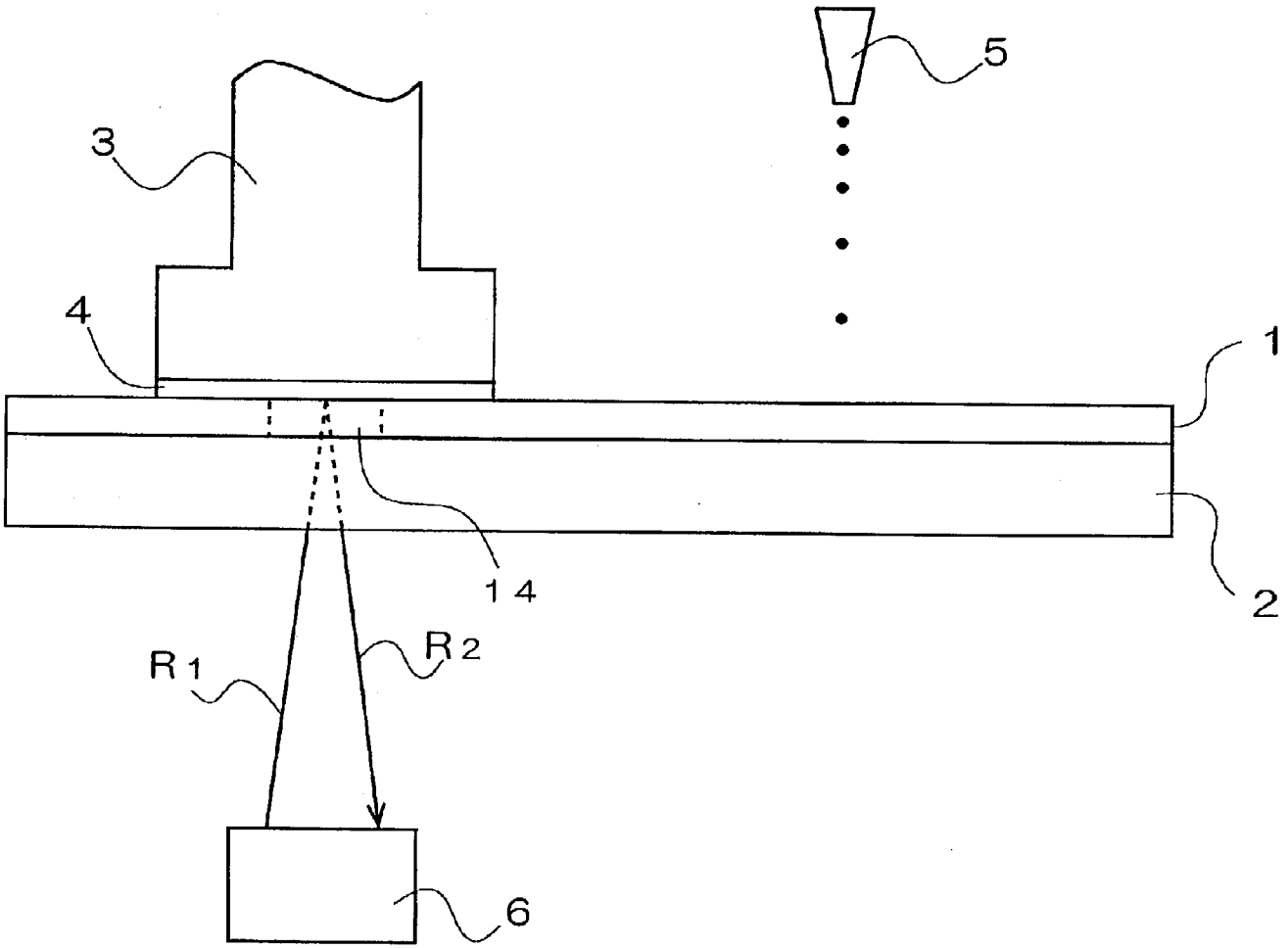
FIG. 24 is a schematic view showing a polishing apparatus using a polishing pad or a laminated body for polishing of the invention.

1: Polishing pad, 11; Thin part, 12; Substrate for polishing pad, 13; Through hole, 14; Light transmitting part, 15; Supporting layer, 2; Surface plate, 3; Pressure head, 4; Semiconductor wafer, 5; Slurry supplying part, 6; Optical endpoint detector, 7; laminated body for polishing, $R_1$; Endpoint detecting light, $R_2$; Reflected light.

DESCRIPTION OF THE PREFERRED EMBODIMENTS

The present invention is further described in detail in the following examples.

EXAMPLE 1

[1] Preparation of a Polishing Pad

80% by volume of 1,2-polybutadiene (trade name "JSR RB830" manufactured by JSR Corp.) which becomes a water-insoluble matrix material by crosslinking later, and 20% by volume of β-cyclodextrin (trade name "Dexypearl β-100" manufactured by Yokohamakokusaibiokenkyusho Co. Ltd.) were kneaded with a kneader heated to 120° C. Thereafter, 0.2 part by mass of dicumyl peroxide (trade name "Percumyl D" manufactured by NOF Corp.) was added to a total of 100 parts by mass of total of 1,2-polybutadiene and β-cyclodextrin, which was further kneaded, reacted to crosslink at 170° C. for 20 minutes in a press mold, and molded to obtain a disc-like polishing pad having a diameter of 60 cm and a thickness of 2 mm.

[2] Measurement of the Transmittance

The transmittance of the resulting polishing pad at a wavelength ranges between 400 and 800 nm was measured at five different points on the polishing pad using a UV absorbance measuring device (Model "U-2010" manufactured by Hitachi Ltd.), and an average was calculated. As a result, an average integrated transmittance of five times was 7%. In addition, the transmittance at 633 nm (wavelength of a general He-Ne laser) was 6.5%.

[3] Measurement of the Polishing Performance

The polishing pad obtained above was mounted on a surface plate of a polishing apparatus, and a hot-oxidized layer wafer was polished under the conditions of a surface plate rotation number of 50 rpm and a slurry flow of 100 cc/min. As a result, a removal rate was 980 Å/min.

EXAMPLE 2

Using a polishing pad composed of commercially available polyurethane foam having no light transmitting properties (trade name "IC1000" manufactured by Rodel Nitta), polishing was performed under the same conditions as those of Example 1, and a removal rate was 950 Å/min. A circular through hole having a diameter of 20 mm was provided on this polishing pad, and a light transmitting part having the same constituent as that of the polishing pad in the above-mentioned Example 1 was fitted therein. Polishing was performed under the same conditions as those of Example 1 using this new polishing pad, and a removal rate was 950 Å/min.

As a result, even when, a light transmitting part molded in a prescribed size is fitted in a through hole provided on a part of a polishing pad composed of polyurethane foam having no light transmitting properties to obtain a polishing pad, which is used to perform polishing, it can be seen that the polishing performance of a polishing pad composed of polyurethane foam having no light transmitting properties is not lowered.

What is claimed is:

1. A polishing pad for a semiconductor wafer, which comprises a water-insoluble matrix material and a water-soluble particle dispersed in said water-insoluble matrix material, and having light transmitting properties.

wherein at least a part of the water-insoluble matrix material is a crosslinked polymer.

2. The polishing pad according to claim 1, wherein said crosslinked polymer is at least one selected from the group consisting of a styrene-based elastomer, a polyolefin elastomer, and a diene-based elastomer.

3. The polishing pad according to claim 1, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

4. The polishing pad according to claim 1, wherein said crosslinked polymer is crosslinked 1,2-polybutadiene.

5. A polishing pad for a semiconductor wafer, which comprises a water-insoluble matrix material and a water-soluble particle dispersed in said water-insoluble matrix material, and having light transmitting properties, wherein the light transmittance of the polishing pad at a wavelength between 400 and 800 mn is 0.1% or more, or an integrated transmittance in a wavelength range between 400 and 800 nm is 0.1% or more, at a polishing pad thickness of 2 mm, and wherein at least a part of the water-insoluble matrix material is a crosslinked polymer.

6. The polishing pad according to claim 5, wherein said crosslinked polymer is at least one selected from the group consisting of a styrene-based elastomer, a polyolefin elastomer, and a diene-based elastomer.

7. The polishing pad according to claim 5, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

8. The polishing pad according to claim 5, wherein said crosslinked polymer is crosslinked 1,2-polybutadiene.

9. A polishing pad for a semiconductor, which comprises a substrate for a polishing pad having a through hole penetrating from the surface to the back, and a light transmitting part fitted in said through hole, wherein said light transmitting part comprises a water-insoluble matrix material and a water-soluble particle dispersed in said water-insoluble matrix material.

10. The polishing pad according to claim 9, wherein the light transmittance of said light transmitting part at a wavelength between 400 and 800 nm is 0.1% or more, or an integrated transmittance of said light transmitting part in a wavelength range between 400 and 800 nm is 0.1% or more, at a thickness of 2 mm.

11. The polishing pad according to claim 10, wherein said pad has a thin part, and an endpoint detecting light is transmitted through said thin part.

12. The polishing pad according to claim 11, wherein at least a part of the water-insoluble matrix material is a crosslinked polymer.

13. The polishing pad according to claim 12, wherein said crosslinked polymer is at least one selected from the group consisting of a styrene-based elastomer, a polyolefin elastomer, and a diene-based elastomer.

14. The polishing pad according to claim 12, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

15. The polishing pad according to claim 12, wherein said crosslinked polymer is crosslinked 1,2-polybutadiene.

16. The polishing pad according to claim 10, wherein at least a part of the water-insoluble matrix material is a crosslinked polymer.

17. The polishing pad according to claim 16, wherein said crosslinked polymer is at least one selected from the group consisting of a styrene-based elastomer, a polyolefin elastomer, and a diene-based elastomer.

18. The polishing pad according to claim 16, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

19. The polishing pad according to claim 16, wherein said crosslinked polymer is crosslinked 1,2-polybutadiene.

20. A laminated body for polishing of a semiconductor wafer, which comprises a polishing pad comprising a water-insoluble matrix material and a water-soluble particle dispersed in said water-insoluble matrix material, and has light transmitting properties and a supporting layer laminated on a backside of said polishing pad, wherein said laminate has light transmitting properties in a laminated direction, and wherein at least a part of said water-insoluble matrix is a crosslinked polymer.

21. The laminated body according to claim 20, wherein said crosslinked polymer is at least one selected from the group consisting of a styrene-based elastomer, a polyolefin elastomer, and a diene-based elastomer.

22. The laminated body according to claim 20, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

23. The laminated body according to claim 20, wherein said crosslinked polymer is crosslinked 1,2-polybutadiene.

24. A laminated body for polishing of a semiconductor wafer, which comprises a polishing pad comprising a substrate for a polishing pad provided with a through hole penetrating from surface to back, and a light transmitting part fitted in said through hole, wherein said light transmitting part comprises a water-insoluble matrix material and a water-soluble particle dispersed in said water-insoluble matrix material, and a supporting layer laminated on a backside of said polishing pad, wherein said laminate has light transmitting properties in a laminated direction, and wherein at least a part of said water-insoluble matrix is a cross-linked polymer.

25. The laminated body according to claim 24, wherein said crosslinked polymer is at least one selected from the group consisting of a styrene-based elastomer, a polyolefin elastomer, and a diene-based elastomer.

26. The laminated body according to claim 24, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

27. The laminated body according to claim 24, wherein said crosslinked polymer is crosslinked 1,2-polybutadiene.

28. A method for polishing of a semiconductor wafer comprising polishing a semiconductor wafer with a laminated body and detecting a polishing endpoint with an optical endpoint detector, wherein the laminated body comprises a polishing pad comprising a water-insoluble matrix material and a water-soluble particle dispersed in the water-insoluble matrix material, and a supporting layer laminated on a backside of said polishing pad, wherein said laminate has light transmitting properties in a laminated direction, and wherein at least a part of said water-insoluble matrix is a cross-linked polymer.

29. The method according to claim 28, wherein said crosslinked polymer is at least one selected from the group consisting of a styrene-based elastomer, a polyolefin elastomer, and a diene-based elastomer.

30. The method according to claim 28, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

31. The method according to claim 28, wherein said crosslinked polymer is crosslinked 1,2-polybutadiene.

32. A method for polishing of a semiconductor wafer comprising polishing a semiconductor wafer with a laminated body for polishing, and detecting a polishing endpoint using an optical endpoint detector, wherein the laminated body comprises a polishing pad comprising a substrate for a polishing pad provided with a through hole penetrating from surface to back, and a light transmitting part fitted in the through hole, and a supporting layer laminated on a backside of said polishing pad, wherein the light transmitting part comprises a water-insoluble matrix material and a water-soluble particle dispersed in said water-insoluble matrix material, wherein the laminate has light transmitting properties in a laminated direction, and wherein at least a part of said water-insoluble matrix is a cross-linked polymer.

33. The method according to claim 32, wherein said crosslinked polymer is at least one selected from the group consisting of a styrene-based elastomer, a polyolefin elastomer, and a diene-based elastomer.

34. The method according to claim 32, wherein said water-soluble particle is at least one of an organic-based water-soluble particle selected from the group consisting of dextrin, cyclodextrin, mannitol, lactose, hydroxypropylcellulose, methylcellulose, starch and protein, or an inorganic-based water-soluble particle.

35. The method according to claim 32, wherein said crosslinked polymer is crosslinked 1,2-polybutadiene.

36. A polishing pad for a semiconductor wafer, which comprises a water-insoluble matrix material and a water-soluble particle dispersed in said water-insoluble matrix material, and having light transmitting properties, wherein a light transmittance at a wavelength between 400 and 800 nm is 0.1% or more, or an integrated transmittance in a wavelength range between 400 and 800 nm is 0.1% or more, at a polishing pad thickness of 2 mm, wherein at least a part of the water-insoluble matrix material is a crosslinked polymer, wherein said crosslinked polymer is at least one of a crosslinked polyurethane resin, a crosslinked epoxy resin, a crosslinked polyacrylic resin, a crosslinked unsaturated polyester resin, a crosslinked vinyl ester resin except for a polyacrylic resin, a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, a crosslinked silicone rubber, a crosslinked fluorine rubber, a crosslinked styrene-isoprene rubber, a crosslinked polyethylene, or a crosslinked poly(fluorinated vinylidene), and wherein said water-soluble particle is at least one of an organic water-soluble particle selected from the group consisting of dextrin, cyclodextrin, mannitol, lactose, hydroxypropylcellulose, methylcellulose, starch and protein, or an inorganic water-soluble particle.

37. The polishing pad according to claim 36, wherein said crosslinked polymer is at least one of a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, or a crosslinked styrene-isoprene rubber.

38. The polishing pad according to claim 37, wherein said pad has a thin part, and an endpoint detecting light is transmitted through said thin part.

39. The polishing pad according to claim 36, wherein said crosslinked polymer is crosslinked 1,2-polybutadiene.

40. The polishing pad for a semiconductor wafer according to claim 39, wherein said pad has a thin part, and an endpoint detecting light is transmitted through said thin part.

41. The polishing pad according to claim 39, wherein at least a part of said polishing pad is provided with a part through which light easily passes.

42. A polishing pad for a semiconductor, which comprises a substrate for a polishing pad having a through hole penetrating from the surface to the back, and a light transmitting part fitted in said through hole, wherein said light transmitting part comprises a water-insoluble matrix material and a water-soluble particle dispersed in said water-insoluble matrix material, wherein a light transmittance of said light transmitting part at a wavelength between 400 and 800 nm is 0.1% or more, or an integrated transmittance of said light transmitting part in a wavelength range between 400 and 800 nm is 0.1% or more, at a thickness of 2 mm, wherein at least a part of the water-insoluble matrix material is a crosslinked polymer, wherein said crosslinked polymer is at least one of a crosslinked polyurethane resin, a crosslinked epoxy resin, a crosslinked polyacrylic resin, a crosslinked unsaturated polyester resin, a crosslinked vinyl ester resin except for a polyacrylic resin, a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, a crosslinked silicone rubber, a crosslinked fluorine rubber, a crosslinked styrene-isoprene rubber, a crosslinked polyethylene, or a crosslinked poly(fluorinated vinylidene), and wherein said water-soluble particle is at least one of an organic water-soluble particle selected from the group consisting of dextrin, cyclodextrin, mannitol, lactose, hydroxypropylcellulose, methylcellulose, starch and protein, or an inorganic water-soluble particle.

43. The polishing pad according to claim 42, wherein said crosslinked polymer is at least one of a crosslinked 1,2-polybutadiene, a crosslinked butadiene rubber, a crosslinked isoprene rubber, a crosslinked acrylic rubber, a crosslinked acrylonitrile-butadiene rubber, a cross linked styrene-butadiene rubber, a crosslinked ethylene-propylene rubber, or a crosslinked styrene-isoprene rubber.

44. The polishing pad according to claim 43, wherein said pad has a thin part, and an endpoint detecting light is transmitted through said thin part.

45. The polishing pad for a semiconductor according to claim 42, wherein said crosslinked polymer is crosslinked 1,2-polybutadiene.

46. The polishing pad according to claim 45, wherein said pad has a thin part, and an endpoint detecting light is transmitted through said thin part.

47. A method for polishing of a semiconductor wafer comprising, polishing a semiconductor wafer with a polishing pad comprising a water-insoluble matrix material and a water-soluble particle dispersed in said water-insoluble matrix material, and having light transmitting properties, and detecting a polishing endpoint with an optical endpoint detector, wherein a light transmittance of said light transmitting part at a wavelength between 400 and 800 nm is 0.1% or more, or an integrated transmittance of said light transmitting part in a wavelength range between 400 and 800 nm is 0.1% or more, at a thickness of 2 mm, wherein at least a part of the water-insoluble matrix material is a crosslinked polymer, wherein said crosslinked polymer is at least one of a crosslinked polyurethane resin, a crosslinked epoxy resin, a crosslinked polyacrylic-based resin, a crosslinked unsaturated polyester resin, a crosslinked vinyl ester resin except for a polyacrylic resin, a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, a crosslinked silicone rubber, a crosslinked fluorine rubber, a crosslinked styrene-isoprene rubber, a crosslinked polyethylene, or a crosslinked poly(fluorinated vinylidene), and wherein said water-soluble particle is at least one of an organic water-soluble particle selected from the group consisting of dextrin, cyclodextrin, mannitol, lactose, hydroxypropylcellulose, methylcellulose, starch and protein, or an inorganic water-soluble particle.

48. The method according to claim 47, wherein said crosslinked polymer is at least one of a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene butadiene rubber, a crosslinked ethylene-propylene rubber, or a crosslinked styrene-isoprene rubber.

49. The method according to claim 48, wherein said pad has a thin part, and an endpoint detecting light is transmitted through said thin part.

50. The method according to claim 47, wherein said crosslinked polymer is crosslinked 1,2-polybutadiene.

51. The method according to claim 50, wherein said pad has a thin part, and an endpoint detecting light is transmitted through said thin part.

52. The method according to claim 50, wherein at least a part of said polishing pad is provided with a part through which light easily passes.

53. A method for polishing of a semiconductor wafer comprising:

polishing a semiconductor wafer with a polishing pad comprising a substrate for a polishing pad having a through hole penetrating from surface to back, and a light transmitting part fitted in said through hole, wherein said light transmitting part comprises a water-insoluble matrix material and a water-soluble particle dispersed in said water-insoluble matrix material, and detecting a polishing endpoint using an optical endpoint detector, wherein a light transmittance of said light transmitting part at a wavelength between 400 and 800 nm is 0.1% or more, or an integrated transmittance of said light transmitting part in a wavelength range between 400 and 800 nm is 0.1% or more, when a thickness is 2 mm, wherein at least a part of the water-insoluble matrix material is a crosslinked polymer, wherein said crosslinked polymer is at least one of a crosslinked polyurethane resin, a crosslinked epoxy resin, a crosslinked polyacrylic-based resin, a crosslinked unsaturated polyester resin, a crosslinked vinyl ester resin except for a polyacrylic resin, a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, a crosslinked silicone rubber, a crosslinked fluorine rubber, a crosslinked styrene-isoprene rubber, a crosslinked polyethylene, or a crosslinked poly(fluorinated vinylidene), and wherein said water-soluble particle is at least one of an organic water-soluble particle selected from the group consisting of dextrin, cyclodextrin, mannitol, lactose, hydroxypropylcellulose, methylcellulose, starch and protein, or an inorganic water-soluble particle.

54. The method according to claim 53, wherein said crosslinked polymer is at least one of a crosslinked 1,2-polybutadiene, a crosslinked butadiene rubber, a crosslinked isoprene rubber, a crosslinked acrylic rubber, a crosslinked acrylonitrile-butadiene rubber, a crosslinked styrene-butadiene rubber, a crosslinked ethylene-propylene rubber, or a crosslinked styrene-isoprene rubber.

55. The method according to claim 54, wherein said pad has a thin part, and an endpoint detecting light is transmitted through said thin part.

56. The method according to claim 53, wherein said crosslinked polymer is crosslinked 1,2-polybutadiene.

57. The method according to claim 56, wherein said pad has a thin part, and an endpoint detecting light is transmitted through said thin part.

* * * * *